US009110494B2

(12) United States Patent
Kim et al.

(10) Patent No.: US 9,110,494 B2
(45) Date of Patent: Aug. 18, 2015

(54) PEDAL DEVICE FOR VEHICLES

(71) Applicants: Hyundai Motor Company, Seoul (KR); DONG HEE INDUSTRIAL CO., LTD., Ulsan (KR)

(72) Inventors: Eun Sik Kim, Gwangmyeong-si (KR); Bum Jun Kim, Bucheon-si (KR); Hee Soo Yang, Busan (KR); Jeong Seon Min, Gwangju (KR); Joon Young Park, Suwon-si (KR); Yang Rae Cho, Suwon-si (KR); Jee Hyuck Choi, Gunpo-si (KR); Yong Hwan Mo, Ulsan (KR); Jong Rae Lee, Ulsan (KR); Dong Hwan Kim, Ulsan (KR)

(73) Assignees: HYUNDAI MOTOR COMPANY, Seoul (KR); DONG HEE INDUSTRIAL CO., LTD., Ulsan (KR)

( * ) Notice: Subject to any disclaimer, the term of this patent is extended or adjusted under 35 U.S.C. 154(b) by 0 days.

(21) Appl. No.: 14/020,043

(22) Filed: Sep. 6, 2013

(65) Prior Publication Data

US 2014/0366677 A1 Dec. 18, 2014

(30) Foreign Application Priority Data

Jun. 17, 2013 (KR) ..... 10-2013-0068968

(51) Int. Cl.
*G05G 1/44* (2008.04)

(52) U.S. Cl.
CPC ..... *G05G 1/44* (2013.01); *Y10T 74/20528* (2015.01)

(58) Field of Classification Search
USPC ..... 74/512–514, 560
See application file for complete search history.

(56) References Cited

U.S. PATENT DOCUMENTS

| | | | | |
|---|---|---|---|---|
| 8,726,759 | B2 * | 5/2014 | Mannle | 74/512 |
| 2007/0157755 | A1 * | 7/2007 | Kim et al. | 74/513 |
| 2008/0314192 | A1 * | 12/2008 | Willemsen et al. | 74/512 |

FOREIGN PATENT DOCUMENTS

| | | | | |
|---|---|---|---|---|
| DE | 102006035882 | A1 * | 2/2008 | B60T 7/06 |
| JP | 2005-508060 | A | 3/2005 | |
| KR | 10-0851321 | B1 | 8/2008 | |
| KR | 10-0863642 | B1 | 10/2008 | |
| KR | 10-2009-0064209 | A | 6/2009 | |
| KR | 10-2010-0045809 | A | 5/2010 | |
| KR | 10-2010-0064079 | A | 6/2010 | |
| KR | 10-2011-0061512 | A | 6/2011 | |
| WO | WO 03/039899 | A2 | 5/2003 | |
| WO | WO 2010/022956 | A1 | 3/2010 | |

* cited by examiner

*Primary Examiner* — Thomas Diaz
(74) *Attorney, Agent, or Firm* — Morgan, Lewis & Bockius LLP

(57) ABSTRACT

A pedal device for vehicles includes: a pedal arm provided in a pedal housing and connected to a pedal pad at a first end thereof, and rotated around a hinge shaft mounted to a second end of the pedal arm; a pressure member, a first end of which is held by the first end of the pedal arm, and a second end of which is placed between the hinge shaft and an inner surface of the pedal housing; and an elastic member provided between a middle portion of the pressure member and the inner surface of the pedal housing, and functioning to impose an elastic reaction force on the pressure member when a driver presses the pedal pad down. The elastic member brings the second end of the pressure member into frictional contact with the inner surface of the pedal housing.

7 Claims, 5 Drawing Sheets

PEDAL DEVICE FOR VEHICLES

CROSS-REFERENCE TO RELATED APPLICATION

The present application claims priority of Korean Patent Application Number 10-2013-0068968 filed Jun. 17, 2013, the entire contents of which application is incorporated herein for all purposes by this reference.

BACKGROUND OF INVENTION

1. Field of Invention

The present invention relates, in general, to a pedal device for vehicles and, more particularly, to a pedal device for vehicles, which can reduce a load imposed on a hinge shaft when a pedal pad is pressed down, thereby improving the durability and wear resistance of parts, and improving the quality of an accelerator position sensor (APS), and which can be reduced in terms of the size of the device and the number of parts, thereby reducing the production cost and weight of the pedal device.

2. Description of Related Art

FIG. 1 illustrates a conventional organ type accelerator pedal device.

As shown in FIG. 1, the conventional organ type accelerator pedal device includes: a pedal housing 1 that is fixedly mounted to a body or floor panel placed below a driver's seat; a pedal pad 2 that is hinged to a pad connection part 1*a* of a pedal housing 1 at a first end thereof, and can be rotated in response to a pedaling action of a driver; a pedal aim 4 that is installed in an inner space 1*b* of the pedal housing 1 in such a way that a middle portion of the pedal arm 4 can be rotated around a rotating shaft 3 relative to the pedal housing 1, and a first end of the pedal arm 4 can come into frictional contact with the inner surface of the pedal housing 1; a carrier 5 that connects the pedal pad 2 to a second end of the pedal arm 4; and an elastic member 6 that is held by a second end of the pedal arm 4 and by the inner surface of the pedal housing 1 at opposite ends thereof, and provides an elastic restoring force to the rotating motion of the pedal arm 4.

Here, a ball 5*a* is provided in a first end of the carrier 5, and so the first end of the carrier 5 can be rotatably hinged to the pedal pad 2 by the ball 5*a*. A second end of the carrier 5 is rotatably hinged to the first end of the pedal arm 4.

However, in the conventional accelerator pedal device for vehicles having the above-mentioned construction, the rotating shaft is installed in the middle portion of the pedal arm, the elastic member is placed on the second end of the pedal arm, and the second end of the pedal arm comes into frictional contact with the inner surface of the pedal housing. Accordingly, the conventional accelerator pedal device for vehicles is problematic in that, to form an appropriate pedal effort of the pedal pad that is higher than a predetermined level, it is required to use a long pedal arm, and so the size of the pedal arm and the size of the pedal housing are increased, thereby increasing the size and weight of the pedal device.

Further, when the pedal pad of the conventional accelerator pedal device is pressed down, the end of the pedal aim comes into frictional contact with the inner surface of the pedal housing. In the above state, a load generated by the pedal pad is concentrated on the bushing that surrounds the rotating shaft, and the concentration of the load causes wear of parts of the pedal device, and reduces the durability of the parts. Further, because the hinged parts are worn due to the concentration of the load, the conventional accelerator pedal device may not produce a reliable output value of an APS.

The information disclosed in this Background section is only for enhancement of understanding of the general background of the invention and should not be taken as an acknowledgement or any form of suggestion that this information forms the prior art already known to a person skilled in the art.

BRIEF SUMMARY

Accordingly, various aspects of the present invention have been made keeping in mind the above problems occurring in the related art.

Various aspects of the present invention provide for a pedal device for vehicles, which can reduce the load imposed on a hinge shaft when a pedal arm is rotated, thereby improving the durability and the wear resistance of parts and improving the quality of an APS.

Various aspects of the present invention provide for a pedal device for vehicles, which can reduce the size of the pedal device and can reduce the number of parts, thereby reducing the production cost and weight of the pedal device.

Various aspects of the present invention provide for a pedal device for vehicles, including: a pedal arm provided in a pedal housing and connected to a pedal pad at a first end thereof, and rotated around a hinge shaft that is mounted to a second end of the pedal arm; a pressure member, a first end of which is held by the first end of the pedal arm, and a second end of which is placed between the hinge shaft and an inner surface of the pedal housing; and an elastic member provided between a middle portion of the pressure member and the inner surface of the pedal housing, and functioning to impose an elastic reaction force on the pressure member when a driver presses the pedal pad down, and so the elastic member brings the second end of the pressure member into frictional contact with the inner surface of the pedal housing.

Here, a rotating shaft may be installed in the first end of the pedal arm, a support part may be formed in the first end of the pressure member in such a way that the support part surrounds a lower part of an outer circumferential surface of the rotating shaft, and the second end of the pressure member may be seated on an upper end of the hinge shaft.

Further, the first and second ends of the pedal arm may be integrated with each other into a single structure by opposite side guides, with the pressure member placed between the opposite side guides.

The pedal device may further include: a friction member provided on the second end of the pressure member which comes into frictional contact with the inner surface of the pedal housing.

The pedal device may further include: a carrier, a first end of which is rotatably mounted to a lower surface of the pedal pad, and a second end of which is rotatably mounted to the first end of the pedal arm by a combination of a shaft and a shaft hole.

The pedal pad may be mounted at a location above the pedal housing, and a cover may be mounted to a side of the pedal pad such that the cover covers the side of the pedal housing.

Here, the elastic member may be a double spring including an outer spring and an inner spring provided inside the outer spring.

The pedal device may further include: a seat groove formed in the inner surface of the pedal housing, on which the elastic member is supported, such that the elastic member is seated in the seat groove.

The above-mentioned pedal devices for vehicles according to the present invention are advantageous in that the pressure member is separated from the pedal arm, and so the load generated by the pedal pad when the pedal pad is pressed down is concentrated on the friction member instead of the hinge shaft of the pedal arm, thereby increasing the frictional force of the friction member while minimizing the frictional wear of both the hinge shaft and the hinge bushing, and in that the hinge shaft can be can prevented from undesirably moving, thereby being able to produce a reliable output value of the APS.

Another advantage of various aspects of the present invention resides in that the pressure member functions to increase the frictional force by coming into frictional contact with the inner surface of the pedal housing, and functions to cause a hysteresis, and so the present invention can reduce the number of parts of the pedal device, and in that the distance between the hinge shaft and the friction member can be reduced, and so the present invention can reduce the sizes of parts and can reduce the production cost and weight of the pedal device.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
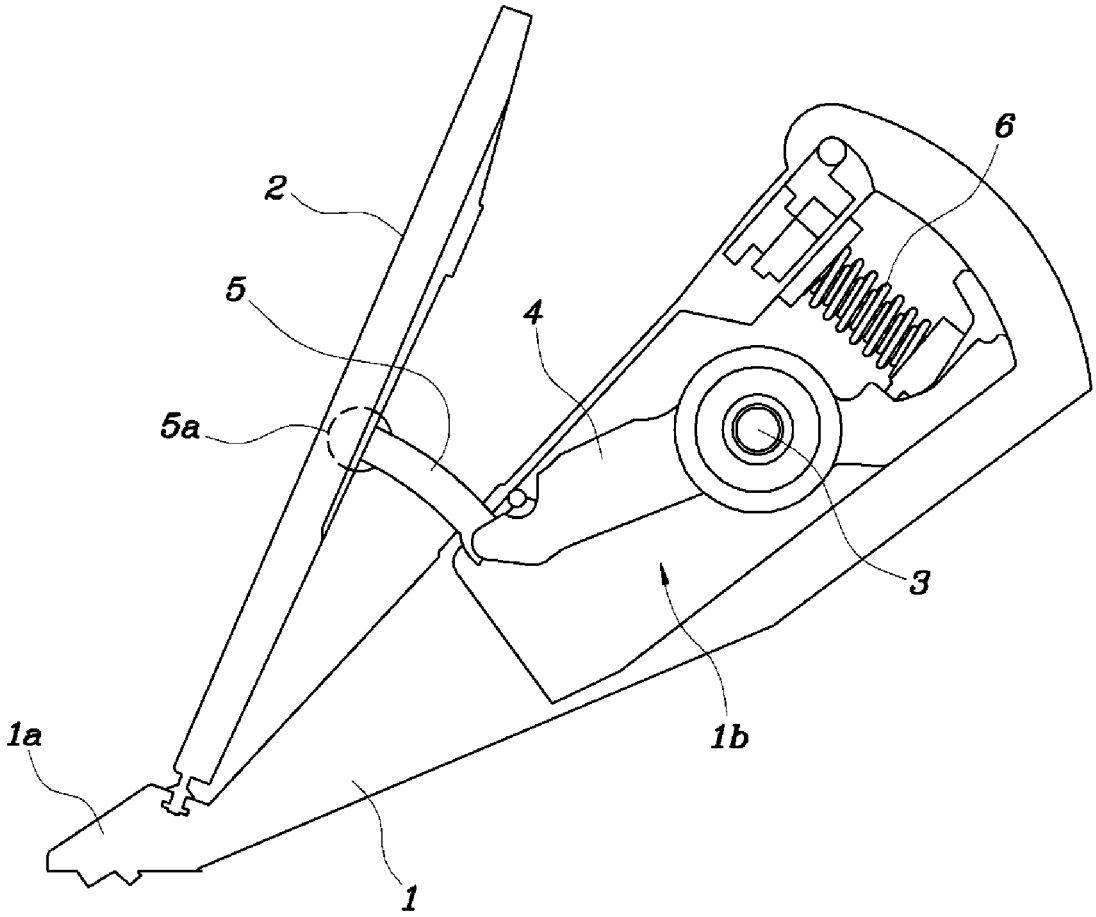
FIG. 1 (Related Art)
FIG. 1 is a view illustrating a conventional accelerator pedal device.
Figure 2:
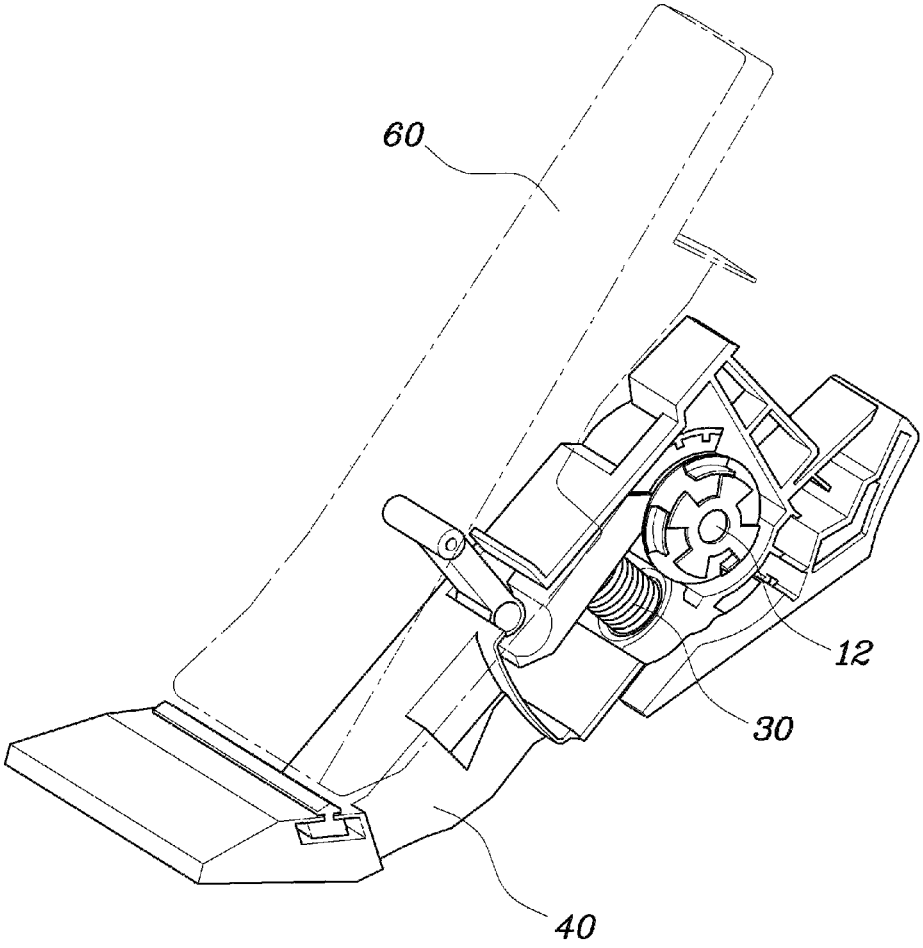
FIG. 2 is a view illustrating the construction of an exemplary pedal device for vehicles according to the present invention.
Figure 3:
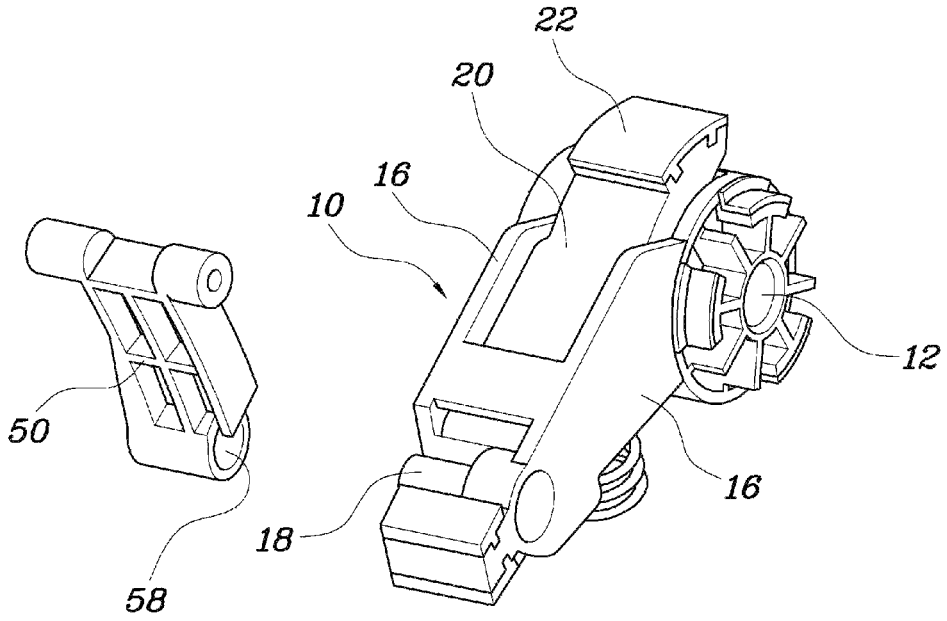
FIG. 3 is a view illustrating the construction of the exemplary pedal device for vehicles according to the present invention, in which a pedal arm and a pressure member are combined with each other, and a carrier is separated therefrom.

FIG. 2 is a view illustrating the construction of a pedal device for vehicles according to the present invention. FIG. 3 is a view illustrating the construction of the pedal device for vehicles according to the present invention, in which a pedal arm 10 and a pressure member 20 are combined with each other, and a carrier 50 is separated therefrom.

The pedal device for vehicles according to the present invention includes the pedal arm 10, the pressure member 20 and an elastic member 30.

As shown in FIGS. 2 and 3, the pedal device for vehicles according to the present invention comprises: the pedal arm 10 that is provided in a pedal housing 40 and is connected to a pedal pad 60 at a first end thereof, and is rotated around a hinge shaft 12 that is mounted to a second end of the pedal arm 10; a pressure member 20, a first end of which is held by the first end of the pedal arm 10, and a second end of which is placed between the hinge shaft 12 and the inner surface of the pedal housing 40; and the elastic member 30 that is provided between a middle portion of the pressure member 20 and the inner surface of the pedal housing 40, and functions to impose an elastic reaction force on the pressure member 20 when a driver presses the pedal pad 60 down, and so the elastic member 30 brings the second end of the pressure member 20 into frictional contact with the inner surface of the pedal housing 40.

Here, a friction member 22 may be provided on the second end of the pressure member 20 which can come into frictional contact with the inner surface of the pedal housing 40. In the present invention, the friction member 22 may be made of a material that can provide a high frictional force.

Figure 6:
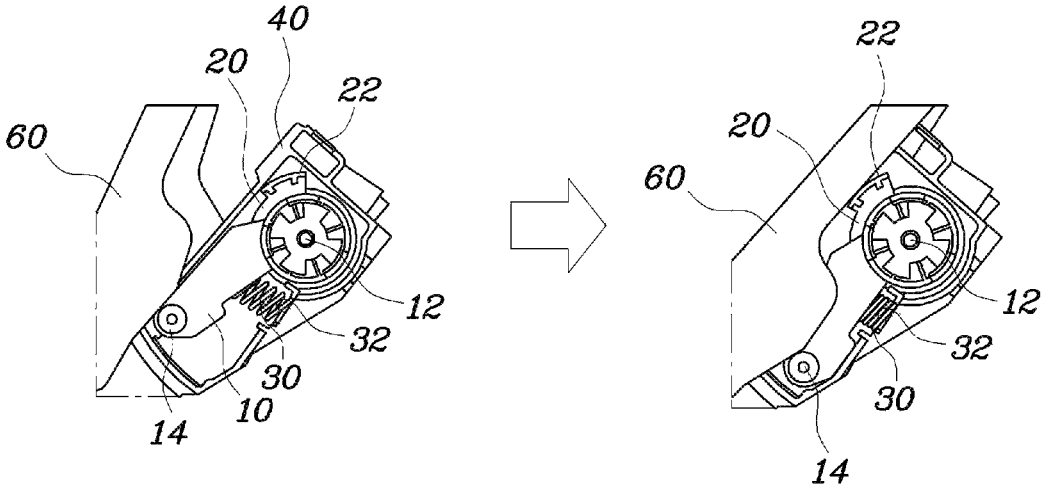
FIG. 6 is a view illustrating the operation of the exemplary pedal device for vehicles according to the present invention when a pedal is worked.

That is, as shown in FIG. 6, when a driver presses the pedal pad 60 down, the first end of the pedal arm 10 is rotated downward around the hinge shaft 12 while compressing the elastic member 30. Because the elastic member 30 is compressed in the above state, the elastic force of the elastic member 30 is increased and the reaction force imposed on the pressure member 20 by the elastic member 30 is increased. Here, because the pedal arm 10 is separated from the pressure member 20, the reaction force formed by the elastic member 30 is concentrated on the pressure member 20, and so the friction member 22 that is provided on the second end of the pressure member 20 can come into fictional contact with the inner surface of the pedal housing 40 with an increased frictional force.

In other words, since the pressure member 20 is separated from the pedal arm 10, a load that is generated by the pedal pad 60 when the pedal pad 60 is pressed down is concentrated on the friction member 22 instead of the hinge shaft 12 of the pedal arm 10. Accordingly, the present invention can increase the frictional force of the friction member 22 while minimizing the frictional wear of both the hinge shaft 12 and the hinge bushing. Further, the present invention can efficiently prevent the hinge shaft 12 from undesirably moving, thereby being able to produce a reliable output value of the APS.

When the driver releases the pressed pedal pad 60, the first end of the pedal arm 10 is elastically rotated upward around the hinge shaft 12 so as to return to its original position. In the above state, the compressed elastic member 30 elastically returns to its original state, and so the elastic force thereof is gradually reduced, and the reaction force imposed on the pressure member 20 by the elastic member 30 is gradually reduced. Here, because the elastic restoring force of the elastic member 30 in the above state is used to promote the upward movement of the pedal arm 10, the frictional force that acts on the inner surface of the pedal housing 40 is reduced. Accordingly, a hysteresis is exhibited between the force acting in the pedal device when the pedal pad 60 is pressed down and the force acting in the pedal device when the pressed pedal pad 60 is released.

As described above, the pressure member 20 of the present invention comes into frictional contact with the inner surface of the pedal housing 40, thereby functioning to increase the frictional force and to cause a hysteresis, and so the present invention can reduce the number of parts of the pedal device and can reduce the production cost of the pedal device.

Figure 4:
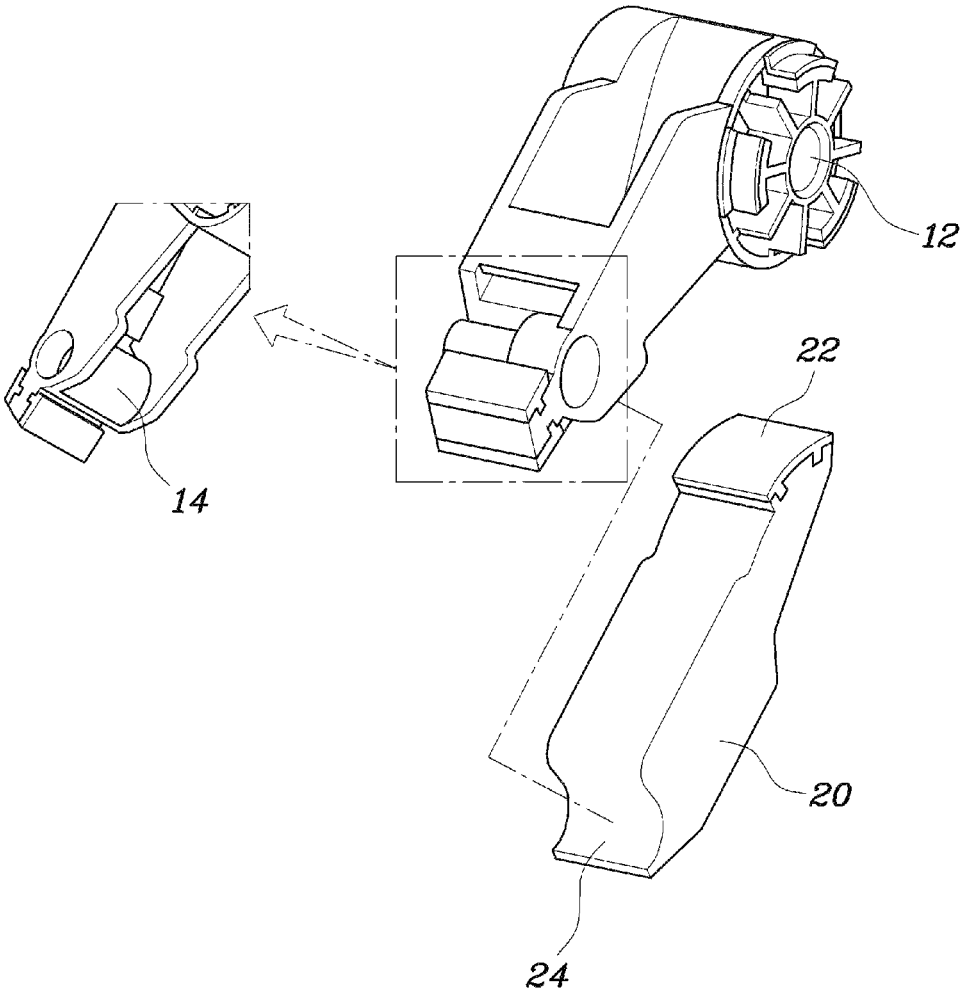
FIG. 4 is a view illustrating the construction of the exemplary pedal device for vehicles according to the present invention, in which the pedal arm is separated from a pressure member.

FIG. 4 is a view illustrating the pedal device for vehicles according to the present invention, in which the pedal arm 10 is separated from the pressure member 20.

As shown in FIG. 4, a rotating shaft 14 is installed in the first end of the pedal arm 10, and a support part 24 is formed in the first end of the pressure member 20 in such a way that the support part 24 surrounds the lower part of the outer circumferential surface of the rotating shaft 14, and the second end of the pressure member 20 is placed so as to be seated on the upper end of the hinge shaft 12.

Here, the first and second ends of the pedal aim 10 are integrated with each other into a single structure by opposite side guides 16, in which the pressure member 20 may be placed between the opposite side guides 16. One will appreciate that such integrated structure may be monolithically formed.

That is, the lower end of the rotating shaft 14 is rotatably seated on the upper surface of the support part 24, and the lower surface part of the second end of the pressure member 20 is seated on and supported by the upper end of the hinge shaft 12. Accordingly, the pressure member 20 can be rotated upward and downward around the rotating shaft 14, and the distance between the hinge shaft 12 and the friction member 22 can be reduced, thereby reducing the sizes of the parts, the production cost and weight of the pedal device.

Further, because the pressure member 20 is placed between the opposite side guides 16, it is possible to prevent the pressure member 20 from being undesirably removed from the pedal aim 10 and allow the pressure member 20 to be efficiently rotated in the space between the opposite side guides 16.

Further, in the present invention, a first end of the carrier 50 is rotatably mounted to the middle portion of the lower surface of the pedal pad 60, and a second end of the carrier 50 is rotatably mounted to the first end of the pedal aim 10. Here, the rotatable combination of the carrier 50 and the pedal arm 10 may be realized by an engagement of the shaft 18 and the shaft hole 58.

That is, the carrier 50 is mounted to the pedal arm 10 using the shaft 18, thereby providing a desired structural strength of the carrier 50 which can prevent the carrier 50 from being removed.

Figure 5:
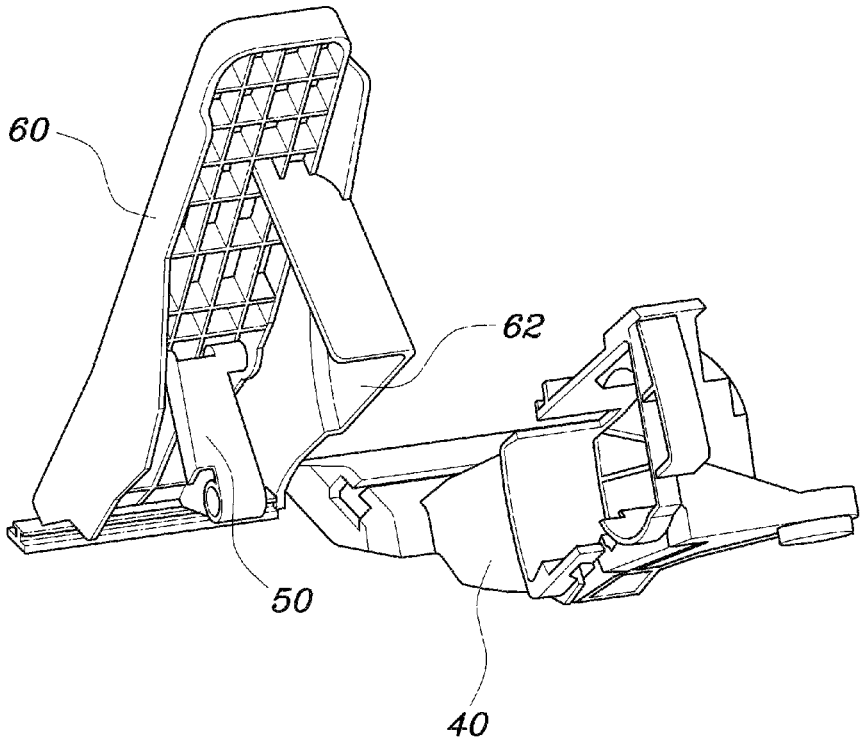
FIG. 5 is a view illustrating a cover of an exemplary pedal housing according to the present invention.

FIG. 5 is a view illustrating a cover 62 of the pedal housing 40 according to the present invention.

As shown in FIG. 5, the pedal pad 60 is mounted at a location above the pedal housing 40, and the cover 62 may be mounted to a side of the pedal pad 60 such that the cover 62 covers the side of the pedal housing 40. Here, the pedal device according to the present invention is an organ type pedal device, in which the lower end of the pedal pad 60 may be rotatably mounted to an end of the pedal housing 40.

That is, the cover 62 can prevent an introduction of impurities into the interior of the pedal housing 40, thereby maintaining a desired operational performance of the pedal device and improving the quality of the pedal device.

Further, as shown in FIG. 6, the elastic member 30 of the present invention may be configured to have a double spring structure that includes an outer spring and an inner spring provided inside the outer spring. Here, to efficiently hold the elastic member 30 on the inner surface of the pedal housing 40, a seat groove 32 may be formed in the inner surface of the pedal housing 40, on which the elastic member 30 is supported, such that the elastic member 30 can be seated in the seat groove 32.

In other words, in an effort to increase the elastic force of the elastic member 30, a double spring comprising an inner spring and an outer spring may be used as the elastic member 30. In this case, the lower end of the double spring is inserted into the seat groove 32, and so the double spring can be prevented from being removed.

For convenience in explanation and accurate definition in the appended claims, the terms upper or lower, front or rear, inside or outside, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A pedal device for vehicles, comprising:

a pedal arm provided in a pedal housing and connected to a pedal pad at a first end of the pedal arm, and rotatable around a hinge shaft mounted to a second end of the pedal arm;

a pressure member including a first end supported by the first end of the pedal arm, and a second end placed between the hinge shaft and an inner surface of the pedal housing; and an elastic member provided between a middle portion of the pressure member and the inner surface of the pedal housing, and imposing an elastic reaction force on the pressure member when a driver presses the pedal pad down;

wherein the elastic member brings the second end of the pressure member into frictional contact with the inner surface of the pedal housing, wherein a rotating shaft is installed in the first end of the pedal arm, the pedal device further comprising a support part formed in the first end of the pressure member to surround a lower part of an outer circumferential surface of the rotating shaft, and wherein the second end of the pressure member is seated on an upper end of the hinge shaft.

2. The pedal device for vehicles as set forth in claim 1, wherein the first and second ends of the pedal arm are a single structure by opposite side guides, with the pressure member placed between the opposite side guides.

3. The pedal device for vehicles as set forth in claim 1, further comprising:

a friction member provided on the second end of the pressure member which comes into frictional contact with the inner surface of the pedal housing.

4. The pedal device for vehicles as set forth in claim 1, further comprising:

a carrier including a first end rotatably mounted to a lower surface of the pedal pad, and a second end rotatably mounted to the first end of the pedal arm by a combination of a shaft and a shaft hole.

5. The pedal device for vehicles as set forth in claim 1, wherein the pedal pad is mounted at a location above the pedal housing, and a cover is mounted to a side of the pedal pad such that the cover covers the side of the pedal housing.

6. The pedal device for vehicles as set forth in claim 1, wherein the elastic member is a double spring comprising an outer spring and an inner spring provided inside the outer spring.

7. The pedal device for vehicles as set forth in claim 1, further comprising:

a seat groove formed in the inner surface of the pedal housing, wherein the elastic member is seated in the seat groove.

* * * * *